US005957621A

United States Patent [19]

Clark, Jr. et al.

[11] Patent Number: 5,957,621

[45] Date of Patent: Sep. 28, 1999

[54] SYSTEM FOR APPLYING LIQUID ASPHALT TO A ROADBED

[76] Inventors: Albert J. Clark, Jr., 2127 Green Creek, San Antonio, Tex. 78232; Eddy J. Clark, 5140 Gibbs Sprawl Rd., San Antonio, Tex. 78219-1199

[21] Appl. No.: 08/803,538

[22] Filed: Feb. 20, 1997

[51] Int. Cl.[6] ..... E01C 19/18; B05B 1/20

[52] U.S. Cl. ..... 404/111; 404/101; 239/159; 239/163

[58] Field of Search ..... 404/101, 104, 404/108, 111; 239/159, 160, 161, 163

[56] References Cited

U.S. PATENT DOCUMENTS

| | | | |
|---|---|---|---|
| 1,137,077 | 4/1915 | Nichols . | |
| 1,884,475 | 10/1932 | Woodcock . | |
| 3,239,148 | 3/1966 | Etnyre | 239/159 |
| 3,512,714 | 5/1970 | Phelps et al. | 239/159 X |
| 3,599,866 | 8/1971 | Bolton | 239/163 X |
| 3,662,953 | 5/1972 | Wiens | 239/159 X |
| 3,782,634 | 1/1974 | Herman . | |
| 3,799,443 | 3/1974 | Foster et al. . | |
| 4,037,664 | 7/1977 | Gibson . | |
| 4,518,118 | 5/1985 | Takata | 239/163 |
| 4,817,870 | 4/1989 | Dalton . | |
| 4,960,242 | 10/1990 | Larson . | |
| 5,337,959 | 8/1994 | Boyd . | |
| 5,549,457 | 8/1996 | Flores et al. | 404/111 X |

FOREIGN PATENT DOCUMENTS

| | | | |
|---|---|---|---|
| 470877 | 2/1992 | European Pat. Off. | 404/111 |

*Primary Examiner*—Tamara L. Graysay
*Assistant Examiner*—Jong-Suk Lee
*Attorney, Agent, or Firm*—Miller, Sisson, Chapman & Nash, P.C.

[57] ABSTRACT

A system for applying a liquid material to a roadway surface from a wheeled, motor-driven vehicle, the system comprising a tank for carrying a liquid material, a first spray bar for discharging the liquid material on to the roadway surface and a second spray bar for discharging the liquid material onto the roadway surface which was not covered by the discharge of the first spray bar. The system includes hydraulic motors and pumps for the first spray bar as well as hydraulic motors and pumps for the second spray bar, the second spray bar being independently controllable to apply liquid asphalt or other suitable material to the roadway at different rates than that liquid asphalt being applied by the first spray bar.

9 Claims, 2 Drawing Sheets

SYSTEM FOR APPLYING LIQUID ASPHALT TO A ROADBED

FIELD OF THE INVENTION

A liquid spreading apparatus, more specifically a motor vehicle carrying hot asphalt for application to a roadway spray path through the use of two spray bars, the first spray covering a first portion of the roadway spray path and the second bar covering the remainder of the roadway spray path.

BACKGROUND OF THE INVENTION

Applicant provides for a motor vehicle for applying a liquid—such as hot asphalt, to the spray path of a roadway through the use of two spray bars mounted at the rear thereof, the first to cover part of the roadway spray path and the second to cover the remainder of the roadway spray path.

Asphalt distributors are used to spray asphalt over a spray path of a roadway surface. This spray path is defined as the width of the intended liquid asphalt spray coverage area, and is typically one lane of a roadway.

Usually, an asphalt distributor has, at the rear thereof, a spray bar with a multiplicity of nozzles pointed downward. Heated liquid asphalt in the tank of the truck is drawn from the tank through a liquid asphalt pump and into the spray bar and shot through the downward pointed nozzles onto the spray path. In prior art liquid asphalt distributors, the multiplicity of nozzles from a single spray bar cover the entire spray path by applying the liquid from each nozzle in a fan shaped spray pattern. The nozzles are mounted to a manifold on the spray bar and the pressure in the manifold is controlled by a control panel to control the rate of application. Through the control panel, the operator can control the amount of liquid asphalt or other material applied to the spray path. However, the present systems are not able to, in a single spray bar, selectively vary the amount of liquid asphalt or other material applied to the spray path at different nozzles. That is, in the present liquid asphalt delivery systems, the operator will select a given coverage (for example, 0.4 gallons per square yard), and that application will be made across the entire spray path unless the user manually changes out nozzles on the spray bar to smaller or larger nozzles for less or more coverage. When this occurs, the nozzles that are either smaller or larger will, of course, apply more or less liquid asphalt than the remaining nozzles. However, it is time consuming to perform such a nozzle changeout and also, once it occurs, requires another changeout of nozzles should the operator desire yet a different application rate. In other words, the present asphalt distribution systems are limited in their flexibility due to the cumbersome nozzle changeout requirements to effect a different application rate.

One reason that operators desire to vary the application rate across a spray path is that along most spray paths there are typically sections where there is extensive pressure exerted by the tires of automobiles and other sections where there is less pressure exerted. If one were to observe traffic moving along a single lane (a typical spray path) they would see that most cars travel so they are "centered" in the middle of the lane and leave a few feet on either side for safety purposes. That is, drivers of vehicles tend to center the vehicles in the lane so that there is a region to each lane where the tires tend to travel and a region between and outside of those tire paths that are not as tire worn.

This fact is important for the purposes of, for example, sealing a road with liquid asphalt. Proper application rates are, in part, a function of subsequent pressure and, as stated above, there is greater pressure applied to certain areas of the spray path after the road has been treated than to other areas. The operator typically desires to apply less liquid asphalt to the tire path of the spray path then to the non-tire path areas so as to prevent subsequent bleeding. This is presently done by swapping out, from the single spray bar, the nozzles that fall over the wheel path with smaller nozzles. As noted above, this is time consuming and not very accurate. That is, it is hard to regulate liquid asphalt application by nozzle jet size when nozzles wear. Further, nozzle changes cannot be made "on the run"—that is, without stopping and swapping out to other, different sized nozzles. Thus, it can be seen that utility lies in providing a means for selectively varying the rate of application across a spray path to allow a different rate of application on the wheel path portion of the spray path as compared to the nonwheel path portion of the spray path. That is, a spray path (typically the width of one lane of traffic) has a wheel path portion and a nonwheel path portion. The wheel path portion is that area which, most of the time, bears the weight of the vehicles traveling over it. The nonwheel path portion is the remainder of the spray path. Utility lies, therefore, since the proper rate of application of liquid asphalt or other material to those two regions of the wheel path often differs, in providing for a liquid asphalt distribution system that will allow such a variable rate.

OBJECTS OF THE INVENTION

It is the object of the invention to provide for, in a liquid asphalt applicator, means to vary the rate of application liquid asphalt onto a roadway surface without changing nozzles such that two areas of the spray path are receiving different rates of application simultaneously.

It is a further object of the invention to provide for changing the rate of application across a spray path without stopping the vehicle.

It is a further object of the present invention to independently control the application of liquid asphalt to a spray path through the use of two separate pumps, two control means, and two spray bars.

SUMMARY OF THE INVENTION

This and other objects are provided for in an asphalt distribution system for spraying liquid asphalt or other liquid material onto a roadway surface, which system is mounted to a moving vehicle, the vehicle moving over the roadway surface, the system comprising a tank carried on the vehicle for holding liquid material; a first spray bar for discharging the liquid material onto a roadway surface, the first spray bar having a multiplicity of nozzles thereon and capable of covering a first section of the roadway with said liquid material, and a second spray bar for discharging said liquid material onto a roadway surface, said second spray bar having a multiplicity of nozzles thereon and capable of covering a second section of the roadway at a rate adjustable with respect to the rate of application of the first spray bar.

DETAILED DESCRIPTION OF THE PREFERRED EMBODIMENT

Figure 1:
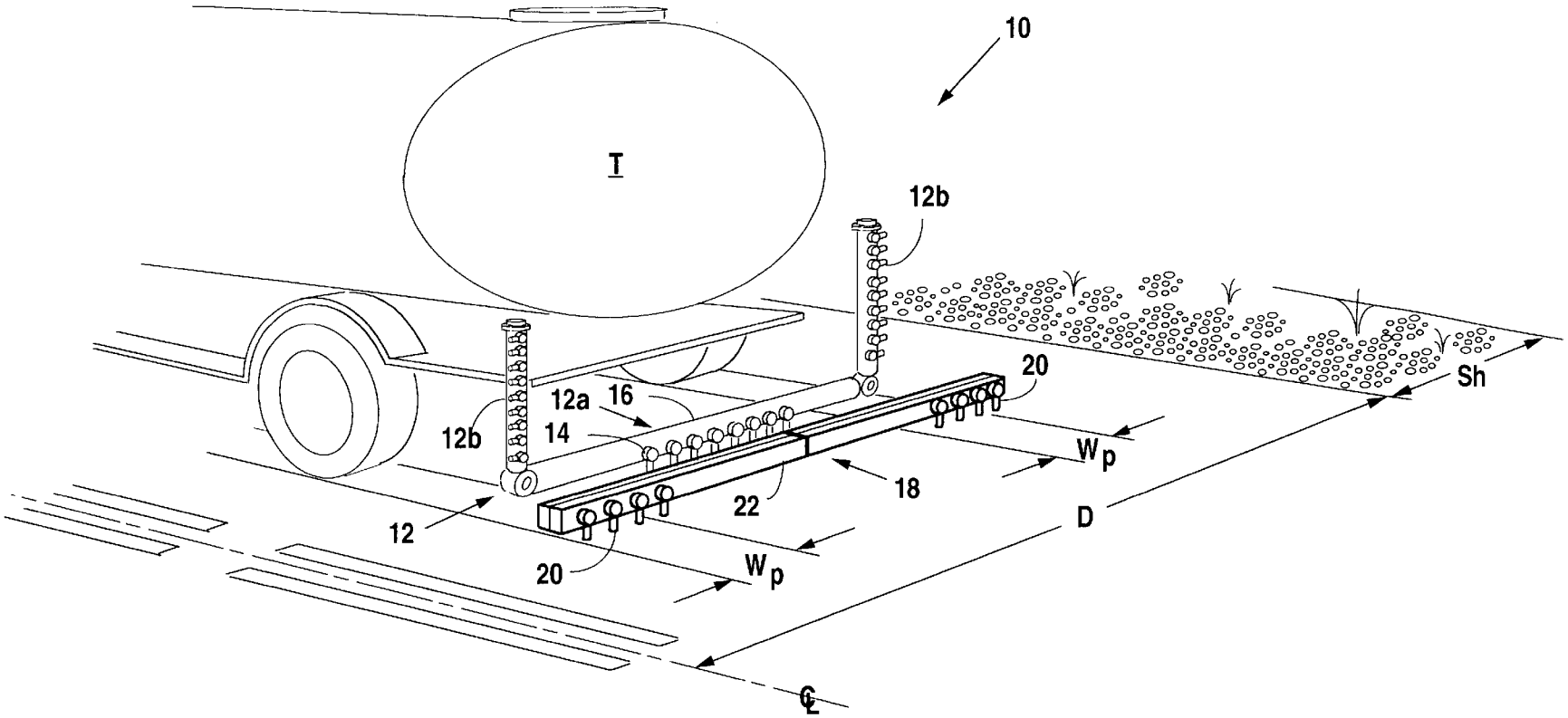
FIG. 1 is a view in perspective of a vehicle incorporating applicants invention in the environment of use, namely, the roadway environment.

FIG. 1 illustrates applicant's asphalt distribution system (10) which is located on a vehicle, such as a truck, having a tank (T), the tank for storage of the liquid asphalt or other suitable material and the vehicle, such as the truck, for transporting the asphalt distribution system.

Turning now to the elements of applicant's asphalt distribution system (10), it is seen to have a first spray bar (12) typically mounted (on mounting members known in the art) behind the rear axle of the truck, the first spray bar (12) typically having a fixed section (12*a*), horizontally mounted beyond the rear axle of the vehicle and two outboard boom sections (12*b*) pivotally mounted to the removed ends of the fixed section for applying liquid material to the roadway outside the removed ends of the fixed section (when the booms are lowered). The first spray bar has a multiplicity of first spray bar nozzles (14) directed downward for applying the liquid material by spraying onto the roadway surface. The first spray bar nozzles are mounted to a first spray bar manifold (16) which is in fluid communication with the jets of the first spray bar nozzles.

Applicant's asphalt distribution system (10) includes a second spray bar (18) mounted on appropriate mounting members (not shown) either fore or aft (typically aft) of the first spray bar and generally parallel thereto and at about the same height. The second spray bar includes a multiplicity of second spray bar nozzles (20) mounted to and in fluid communication with a second spray bar manifold (22).

It behooves the reader at this point to examine the environment in which applicant's asphalt distribution system (10) operates. As stated above, the system is mounted to a truck which, for the sake of illustration in FIG. 1, moves in the direction of the arrow indicated. Again, for the sake of illustration, the operator intends to cover with liquid asphalt or other suitable liquid material a spray path defined as (D), which is about equal to the width of a single lane, here defined to be between center line (CL) and shoulder (SH) of the road. The center line is shown to be a double yellow line, again for the sake of illustration. Across the spray path (D) which typically represents the width of a single lane, there is an area heavily traveled by the tires of automobiles, trucks, and other vehicles defined here as wheel path (WP). The wheel path is typically centered an equal distance in from the center line and shoulder since most cars tend to try to maintain a safe distance on the outside and the inside of the vehicle from the center line and shoulder, respectively. The wheel path, of course, represents an area of heavy wear and, as set forth above, preferably requires a different rate of application of liquid asphalt or other suitable material. Therefore, it is seen that the spray path is comprised of two portions, a wheel path portion (representing the more heavily traveled part of the road) and a nonwheel path portion.

Understanding the environment in which the system operates, attention is directed to the location of the nozzles on the first spray bar and the second spray bar. More particularly, it is noted that the section of the first spray bar above the wheel path either has no nozzles or has the nozzles blanked off to prevent flow, whereas the section of the second spray bar above the wheel path has nozzles with the remainder of the bar having nozzles either blanked off or no nozzles at all. Thus, when fluid is applied under pressure to the manifolds of the respective spray bars and the nozzles direct the fluid downward onto the spray path, complete coverage across the entire spray path is provided with the first spray bar covering the nonwheel path portions of the spray path and the second spray bar covering the wheel path portions. As set forth below, applicant's asphalt distribution system provides a separate pump and controls for each of the two spray bars, thus allowing different rates of application of liquid asphalt or other suitable material to the roadway surface.

Figure 2:
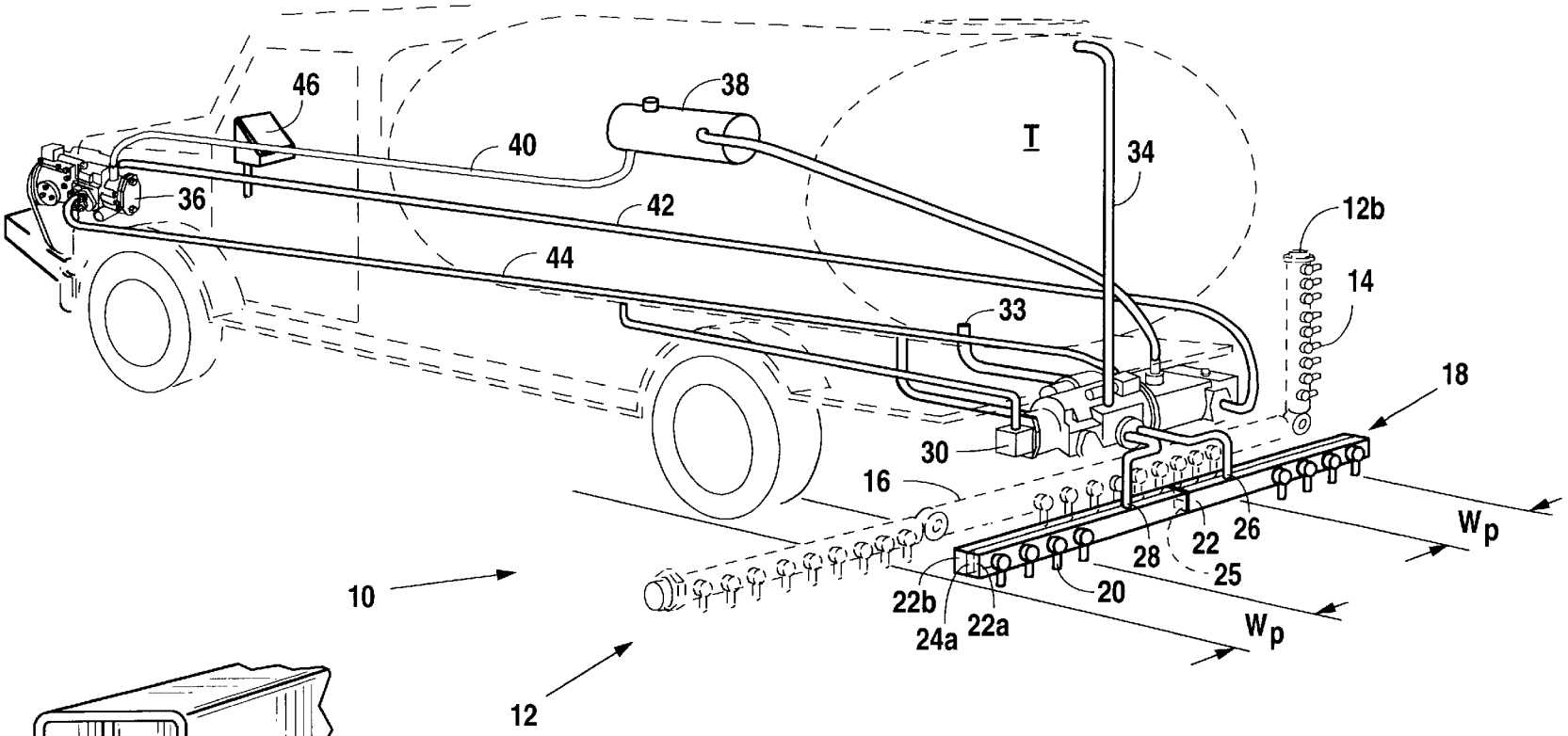
FIG. 2 is a view in perspective of applicants invention as incorporated on a vehicle, here a liquid asphalt truck "T".
Figure 3:
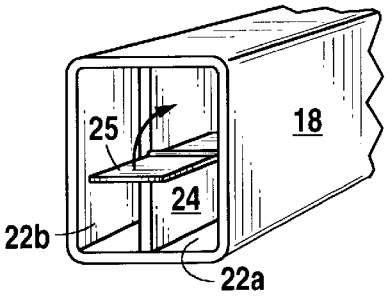
FIG. 3 is a view in perspective of a cut away of the manifold of the second spray bar showing a valve therein.

FIG. 2, when viewed in conjunction with FIGS. 1 and 3, reveals further details of applicant's asphalt distribution system (10). It is seen that second spray bar manifold (22) is divided longitudinally into two chambers, a nozzle chamber (22*a*) and a chamber adjacent to the nozzle chamber for recirculation, that is, a recirculation chamber (22*b*). Separating the nozzle chamber from the recirculation chamber is an interior divider wall (24). However, near the ends of the second spray bar (18), interior divider wall (24) ends to allow fluid circulation between the nozzle chamber and the recirculation chamber. This gap is divider wall gap (24*a*). Liquid asphalt or other suitable material is provided to the nozzle chamber of the second spray bar manifold (22) through the use of spray bar feed line (26). A spray bar feed/return line (28) is also provided for in fluid connection with nozzle chamber (22*a*). Between the juncture of lines (26) and (28) lies valve (25). (See also FIG. 3).

About midway between the removed ends of second spray bar (18) and located within nozzle chamber (22*a*), valve (25) moves between an open position (as illustrated) and a closed position, the closed position for substantially preventing movement of liquid material, under pressure, through the nozzle chamber past the valve.

The function of valve (25) is that, when both lines (26) and (28) are providing fluid under pressure to nozzle chamber (22*a*), the valve is open to allow pressure in the nozzle chamber, and therefore at the jets, to be the same across the second spray bar. However, when the nozzles are off and the spray bar is not shooting, the valve is in a closed position and the spray bar is in a recirculation mode with line (28) acting as a return line and line (26) acting as a feed line to keep the liquid asphalt in circulation.

The tank (T) of the truck carries the liquid asphalt, which is pumped through lines (26) and (28) to second spray bar (18) through the use of a liquid asphalt pump (30). Liquid asphalt pump (30) is, in turn, driven by hydraulic motor (32). Liquid asphalt pump supply line (33) connects storage tank (T) of the truck in which liquid asphalt is carried with liquid asphalt pump (30). However, liquid asphalt pump return line (34) is provided to return excess pumped fluid to the storage tank.

Hydraulic motor (32) is driven by hydraulic fluid pump (36) which, in turn, is driven by the engine of the motor vehicle or truck (engine not shown). Hydraulic fluid pump (36) receives hydraulic fluid from an hydraulic fluid storage tank (38) through an hydraulic fluid pump supply line (40). Hydraulic fluid pump (36) engages hydraulic motor (32) through hydraulic motor pressure line (42) with the hydraulic motor fluid return line (34) being provided to close the fluid circuit.

The pumps and motors set forth above are all known in the art. The nonwheel path spray rates are typically in the range of 0.25 to 0.65 gallons per square yard, with a preferred range of 0.30 to 0.45 gallons per square yard. The wheel path spray rates are typically in a broad range of 0.15 to 0.40 gallons per square yard, typically in the range of 0.20 to 0.38 gallons per square yard. While the pumps and motors set forth above are known in the trade, a smaller capacity liquid asphalt pump (30) is typically utilized, for example, a 3-inch to 4-inch pump. Applicant also provides a second control panel (46) such as that manufactured by and available from BearCat Manufacturing of Wickenburg, Ariz. Typically the second control panel is provided adjacent, or even as part of the control panel for the first spray bar. Extra switches are added to cut in/out the additional nozzles of the second spray bar to widen the wheel path (or to narrow the wheel path by cutting off the nozzles). The wheel path on each side is typically 2 feet to 4 feet, but could be up to 6 feet. That is, the total width of the wheel path could be up to 3 or more feet on each side (6-foot total). Typically, the second spray bar nozzles cover wheel paths 1.5 to 2 feet in width on each side. Manifolds typically carry 3 nozzles per foot, and each 1-foot section of the spray bar can be cut in or out using switches and circuits known in the art and provided for on the second control panel (46).

Applicant's asphalt distribution system, specifically the second spray bar and the related liquid asphalt pump (30), hydraulic motor (32), and hydraulic fluid pump (36), can all be retrofitted to a typical prior art single-spray bar asphalt distribution system. That is, applicant's asphalt distribution system adds to a single spray bar system (which has its pump, motor, and control panel), a complete second system utilizing, typically, the same tank and liquid asphalt as the first spray bar, but having a second control system, liquid asphalt pump, hydraulic motor, and hydraulic fluid pump as set forth in FIGS. 1 and 2 above. Applicant's second spray bar is typically 8 feet wide, but the width may vary. This puts nozzles over the wheel path to allow the operator to cut out the nozzles of the first spray bar so they are not spraying over the wheel path. Applicant adds additional pumps and motors and a control panel to allow the application of liquid asphalt or other appropriate material over the wheel path at a different rate than over the rest of the spray path.

Another preferred embodiment of applicants invention includes a second tank separate from the first tank so that the second spray bar can draw a second liquid from the second tank and apply it to the wheel path. With the pump feeding the second control bar engaged with a second tank, a different composition of material may be applied as compared to the material from the first tank that is being contemporaneously applied to the roadway.

Terms such as "left," "right," "up," "down," "bottom," "top," "front," "back," "in," "out," and like are applicable to the embodiments shown and described in conjunction with the drawings. These terms are merely for purposes of description and do not necessarily apply to the position or manner in which the invention may be constructed for use.

Although the invention has been described in connection with the preferred embodiment, it is not intended to limit the invention's particular form set forth, but on the contrary, it is intended to cover such alternatives, modifications, and equivalences that may be included in the spirit and scope of the invention as defined by the appended claims.

What is claimed is:

1. On a liquid asphalt distribution truck having a tank carrying liquid asphalt and having a first spray bar with a first multiplicity of nozzles thereon for directing liquid asphalt onto a roadway surface, an asphalt distribution system comprising:

a second spray bar mounted behind the truck and generally parallel to the first spray bar, the second spray bar with a multiplicity of second spray bar nozzles for directing liquid asphalt onto the roadway surface; and an independent liquid asphalt pump in fluid communication between the tank and the second spray bar for pumping liquid asphalt out of the tank through only the second spray bar and onto the roadway surface.

2. The system of claim 1 further including a hydraulic motor to drive the liquid asphalt pump.

3. The system of claim 2 further including a control panel for independently controlling the rate of application of the liquid asphalt from the second spray bar to the roadway surface.

4. On a liquid asphalt distribution truck having a tank carrying liquid asphalt and having a first spray bar with a first multiplicity of nozzles thereon for directing liquid asphalt onto a roadway surface, an asphalt distribution system comprising:

a second spray bar mounted behind the truck and generally parallel to the first spray bar, the second spray bar with a multiplicity of second spray bar nozzles for directing liquid asphalt onto the roadway surface;

a liquid asphalt pump independent of the first spray bar in fluid communication between the tank and the second spray bar for pumping liquid asphalt out of the tank through the second spray bar and onto the roadway surface;

a hydraulic motor to drive the liquid asphalt pump; and a control panel for independently controlling the rate of application of the liquid asphalt from the second spray bar to the roadway surface.

5. A method of retrofitting an asphalt distribution truck having a tank for carrying liquid asphalt and further having a single spray bar asphalt distribution system with a first spray bar mounted transversely across the longitudinal axis of the truck adjacent the rear bumper of the truck, the method comprising the steps of:

mounting to the truck a second spray bar adjacent and parallel with the first spray bar; and adding to the truck a hydraulic pump for pumping liquid asphalt from the tank to the second spray bar, a motor to drive the hydraulic pump, and a control panel to control only the liquid asphalt being delivered to the second spray bar.

6. A method of applying liquid asphalt from a liquid asphalt truck having a first spray bar with a first multiplicity of nozzles for covering a first section of roadway, the method comprising the steps of:

providing a second spray bar mounted behind the truck and generally parallel to the first spray bar, the second spray bar with a multiplicity of second spray bar nozzles for directing liquid asphalt onto the roadway surface;

a liquid asphalt pump in fluid communication between the tank and the second spray bar for pumping liquid asphalt out of the tank through the second spray bar and onto the roadway surface;

a hydraulic motor to drive the liquid asphalt pump; and a control panel for controlling, independent of the first spray bar, the rate of application of the liquid asphalt from the second spray bar to the roadway surface;

selecting a first rate of application of liquid asphalt through the first spray bar;

selecting a second rate of application of liquid asphalt through the second spray bar; and applying liquid asphalt to the roadway surface through the first and second spray bars.

7. The method of claim 6, wherein either of the selecting steps are performed while the truck is in motion.

8. The method of claim 6, wherein the first rate of application of the selecting step is different than the second rate of application of the selecting step.

9. The method of claim 6, wherein the providing step includes the step of first providing at least some of the second multiplicity of nozzles in a location on the second spray bar to selectively cover a roadway surface not covered by application of liquid asphalt in the applying step through the first spray bar.

* * * * *